US006012466A

United States Patent [19]

Apanasewicz

[11] Patent Number: 6,012,466

[45] Date of Patent: Jan. 11, 2000

[54] HAIR CURLER

[76] Inventor: Theresa D. Apanasewicz, 2006 Glendon Ave., Los Angeles, Calif. 90025-6324

[21] Appl. No.: 09/327,947

[22] Filed: Jun. 8, 1999

[51] Int. Cl.[7] ..... A45D 2/00; A45D 2/12; A45D 7/02

[52] U.S. Cl. ..... 132/222; 132/223; 132/226; 132/212

[58] Field of Search ..... 132/222, 223, 132/226, 242, 245, 247, 253, 262, 212

[56] References Cited

U.S. PATENT DOCUMENTS

| | | | |
|---|---|---|---|
| 2,163,375 | 6/1939 | Garza | 132/222 |
| 3,106,213 | 10/1963 | Clark | 132/40 |
| 3,529,608 | 9/1970 | Mates | 132/40 |
| 5,538,021 | 7/1996 | Kim | 132/222 |
| 5,588,449 | 12/1996 | Falcon | 132/208 |
| 5,662,128 | 9/1997 | Habibi | 132/222 |
| 5,715,846 | 2/1998 | Kim . | |

FOREIGN PATENT DOCUMENTS

| | | | |
|---|---|---|---|
| 483816 | 2/1970 | Japan | 132/222 |
| 354905 | 7/1961 | Switzerland | 132/222 |
| 389840 | 7/1965 | Switzerland | 132/222 |

*Primary Examiner*—John J. Wilson
*Assistant Examiner*—Robyn Doan
*Attorney, Agent, or Firm*—John J. Leavitt

[57] ABSTRACT

Presented are three embodiments of a hair curler including in one embodiment an apertured tubular member having an apertured felt-like layer secured to the tubular member. A flexible anchor pad having flexible hook-like protrusions is adhered to the felt-like layer diametrically opposite the abutting ends of the felt-like layer. An elongated paper-like strip is attached by one end portion to the felt-like layer, and may be wound about the felt-like layer in either direction so as to overlap the anchor pad. In a second preferred embodiment, the flexible felt-like layer is secured to only one half of the outer periphery of the tubular member. The remainder of the outer periphery of the tubular member is covered directly by a flexible pad having flexible hook-like protrusions for detachable attachment thereto of the elongated paper-like strip. After attachment, the elongated paper-like strip may be wound with a tress of hair about the tubular base member. In the third embodiment, the outer periphery of the tubular base member is totally wrapped by the anchor pad having flexible hook-like projections so that opposite ends of the pad abut in a plane that is coincident with the longitudinal axis of the tubular member. The flexible pad of felt-like material is superimposed over the abutted ends of the anchor pad so as to detachably engage the flexible hook-like members. The elongated paper-like strip is detachably mounted on the flexible anchor pad.

24 Claims, 5 Drawing Sheets

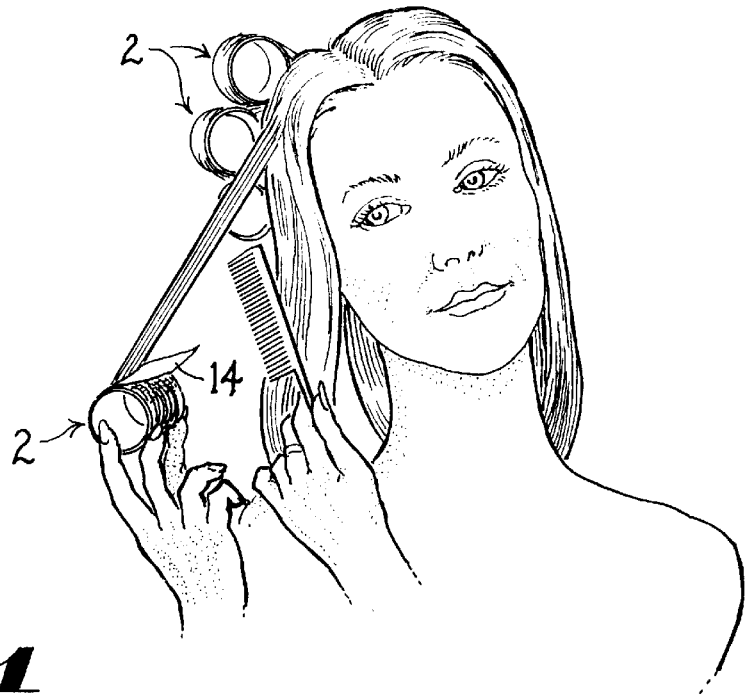
Fig_1
Fig_2
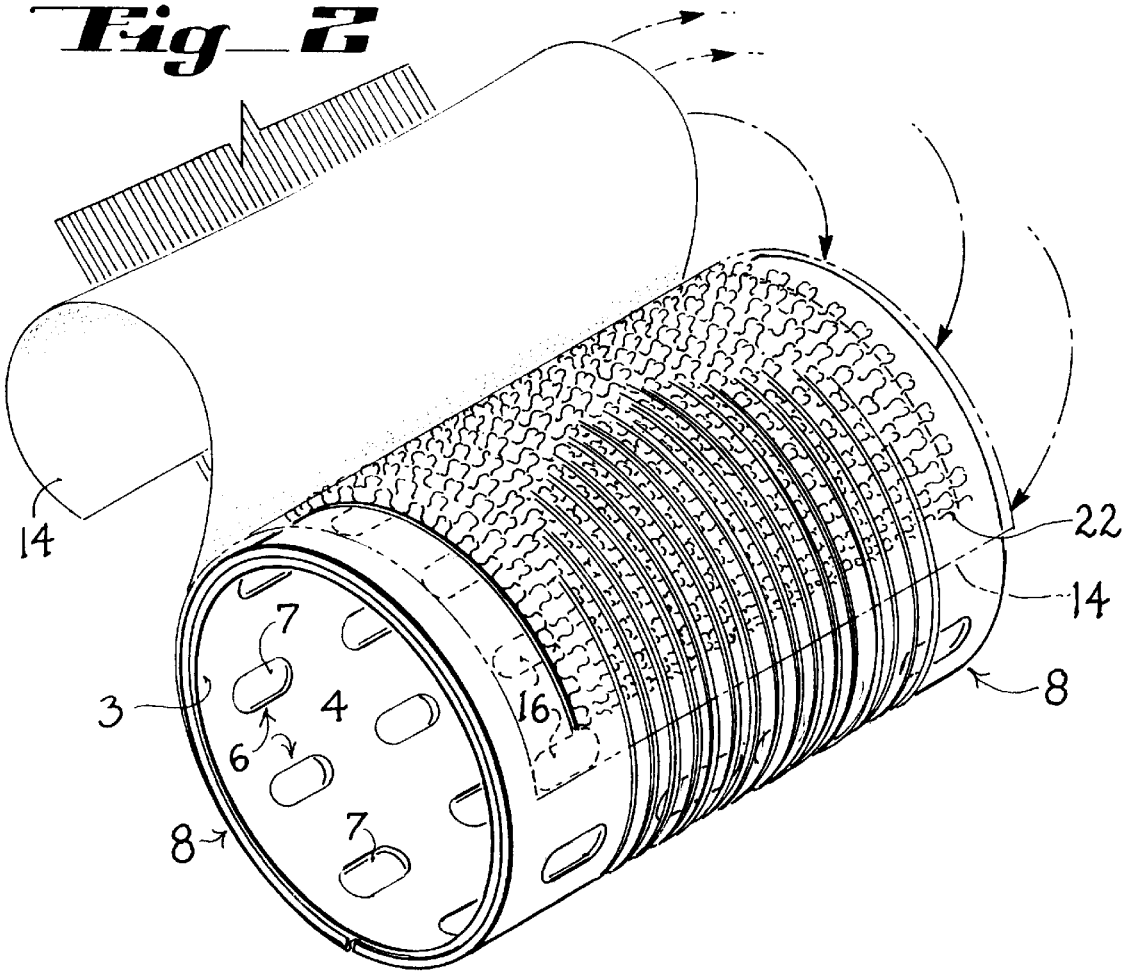

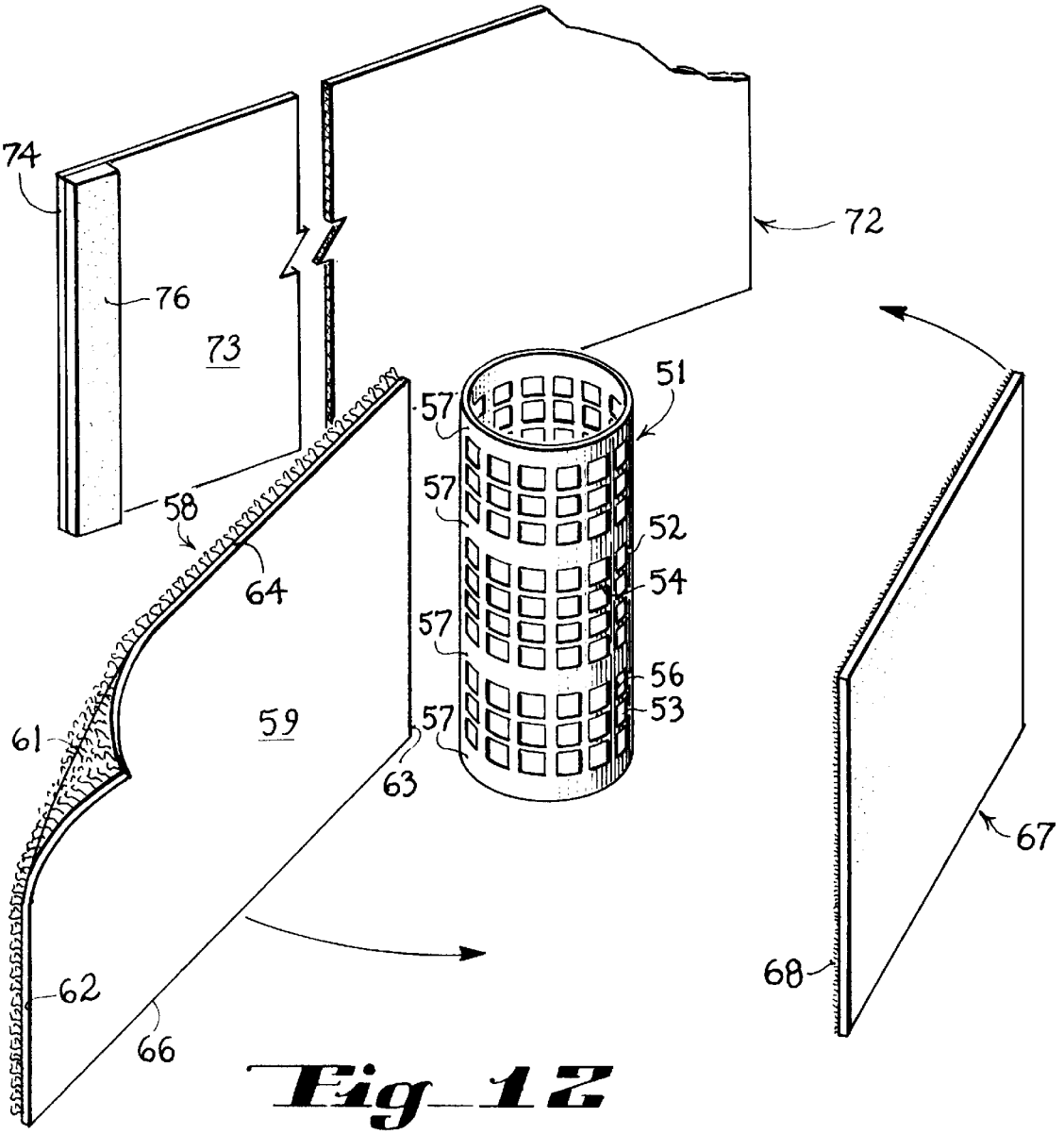
Fig_12
Fig_13
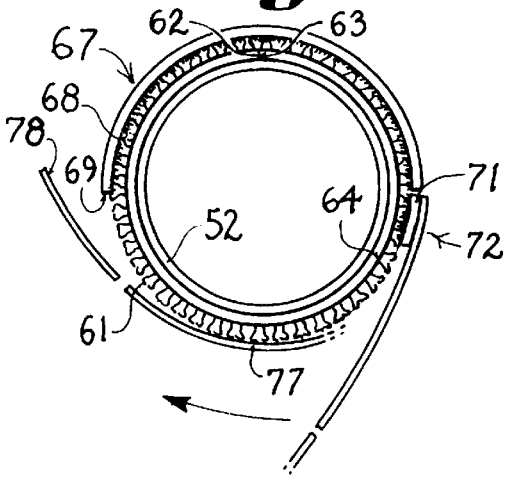

HAIR CURLER

BACKGROUND OF THE INVENTION

1. Field of the Invention

This invention relates to devices for curling hair, and more particularly to a hair curling device incorporating a cylindrical support assembly having a predetermined diameter and length and incorporating anchor means to which the distal or terminal end portion of a tress of hair may be temporarily secured, means precluding entanglement of the remaining length of the tress on the anchor means when the tress is wound about the cylindrical support assembly, and means for retaining the tress of hair temporarily wound on the cylindrical assembly.

2. Description of the Prior Art

The practice of "dressing" hair, particularly hair on the heads of women, but also hair on the heads of men, extends back through history for an essentially indeterminate length of time. Because the "dressing" of hair usually, but not always, involves dividing the hair into separate tresses and then manipulating each individual tress to give it a selected form and then applying some type of solution to cause the hair to remain, more or less, in the form to which it has been manipulated, it has become the practice to temporarily support the manipulated or "curled" tress of hair on some type of support structure for an appropriate length of time, during which the treated hair will "set", i.e., assume the configuration into which it has been manipulated.

To support the manipulated hair until it "sets", many types of hair curler devices have been invented and produced through the years. A preliminary patentability and novelty search conducted in connection with the present invention has revealed the existence of the following five United States patents:

U.S. Pat. Nos. 3,106,213 3,529,608 5,538,021 5,588,449 5,715,846

U.S. Pat. No. 3,106,213 essentially describes and illustrates a hair curler comprising a helically wound cylindrically elongated spring support structure about the outer periphery of which is wrapped a netting material have diamond shaped openings therein. A brush having radially extending bristles is mounted within the spring support structure so that the distal ends of the bristles project through the openings in the netting material. Hair is wound about the cylindrical support spring and lies embedded below the ends of the bristles. Since the ends of the bristles may irritate the scalp when they come into contact therewith, a protective sheet of puncture proof plastic is attached to the spring support and may be wound about the curled hair tress so as to be disposed between the ends of the bristles and the scalp.

U.S. Pat. No. 3,529,608 describes and illustrates a hair curler formed from a generally cylindrical tubular member having a planar recess in its outer periphery on which is secured a hook strip on which the distal ends of a tress of hair may be engaged prior to winding the remainder of the tress about the tubular member. Hair pins inserted through apertures in the tubular wall of the cylindrical member retain the curler in position after rolling.

U.S. Pat. No. 5,538,021 discloses and illustrates a hair winder for permanent waves comprising essentially a spool on an intermediate surface of which is mounted an adhesive strip. A length of foil is attached by one end to the adhesive strip, and is rolled along with the tress of hair so that the layers of wound or rolled hair are separated from one another. In another aspect of the invention the length of foil may itself be provided with hair engaging means that engages the hair as it is wound on the spool.

U.S. Pat. No. 5,588,449 relates to a complex structure and method for highlighting hair and includes a first member in the form of a spool and a second member in the form of a cap that fits over the spool. A flexible sheet with a slit is attached to the cap. A section of hair is separated into two strands or tresses, with one tress being wound on the spool member and the second strand fed through the slit in the protective flexible sheet. After the requisite number of devices have been applied to the head, an appropriate chemical is applied to the strand or tress of hair that is fed through the slit, thus highlighting these particular portions of the hair. Aluminum foil is then wrapped about the treated hair to enhance the amount of heat that is applied to the treated hair from the chemical reaction that results from the application of the chemical to the hair.

U.S. Pat. No. 5,715,846 is similar to the structure disclosed in U.S. Pat. No. 5,538,021 issued to the same inventor, and discloses an elongated strip of material on which are formed hook-like projections over the entire length of the strip. One end portion of the strip is rolled to form a tubular form integral with the remainder of the strip, and a strand or tress of hair is then applied to the tubular form and the remainder of the strip is then rolled up to envelop the strand of hair and to cause engagement of the entire length of the strand of hair with the hook-like protrusions projecting from the strip.

Experience has taught that when an elongated tress or strand of human hair is caused to adhere over its entire length to a supporting structure during the "curling" process, the hair frequently gets tangled with the hair retention means, necessitating the untangling thereof prior to continued rolling of the support structure. Additionally, it has been found that the removal of a hair curling device that fully engages the entire length of a tress or strand of hair imposes stress on the hair, frequently causes pain to the person whose hair is being curled, and makes removal of the hair curler more difficult and time consuming, and therefore lessens the number of customers that can be served by a hairdresser in a given time.

Accordingly, one of the important objects of the present invention is the provision of a hair curler that temporarily engages only the distal end portion of a strand or tress of hair, thus reducing the risk of entanglement and making removal less difficult and time consuming and eliminating stress to the hair.

Another object of the invention is the provision of a hair curler that is constructed in such a manner that a strand or tress of hair, either wet or dry, can be wound onto the hair curler by selective rotation of the hair curler in either direction without entanglement of the hair.

Still another object of the invention is the provision of a hair curler that is economical to manufacture, may be constructed in different diameters to accommodate different lengths of hair or provide tighter curls, and incorporates means for the passage of air through the wound curl to expedite drying of the curled hair.

Yet another object of the invention is the provision of a hair curler incorporating anchor means for temporarily engaging only the distal end portion of a strand or tress of hair, and cooperating means for shielding and precluding the remaining portion of the strand or tress from engagement with the anchor means.

The invention possesses other objects and features of advantage, some of which, with the foregoing, will be apparent from the following description and the drawings. It is to be understood however that the invention is not limited to the embodiment illustrated and described but may be embodied in various forms within the scope of the appended claims.

SUMMARY OF THE INVENTION

In terms of broad inclusion, in one preferred embodiment of the invention, the hair curler of the invention comprises a tubular support assembly, preferably cylindrical but not necessarily so, that includes a tubular member symmetrical about a longitudinal axis and having multiple apertures formed in the wall thereof for the passage of air therethrough. An apertured felt-like covering layer or member coaxially surrounds and is adhesively secured to the cylindrical member in one embodiment so that its opposite ends lie closely adjacent to one another. An anchor means comprising a pad having hook-like protrusions is adhered to the felt-like covering layer or member diametrically opposite the near-abutting ends of the felt-like covering member. An elongated strip of paper-like material that admits the passage of air therethrough is attached by one end portion in one embodiment to the underlying cylindrical member and an associated overlying end portion of the felt-like covering member, and extends radially from between the adjacent near-abutting ends of the felt-like covering in a sufficient length that it may be wound about the felt-like covering member in either direction so as to completely overlap circumferentially the anchor means having exposed hook-like protrusions and extend beyond it for a predetermined or indeterminate length, determined by the length of a tress with which it is associated in use.

In a second preferred embodiment of the invention, a tubular member symmetrical about a longitudinal axis and having multiple apertures in the wall thereof for passage of air is provided with a felt-like covering member adhesively secured to only about one half or slightly more of the outer peripheral surface of the tubular member. The remainder of the outer periphery of the tubular member is covered directly by a pad adhesively secured to the underlying tubular member and having hook-like protrusions for detachable attachment thereto of an elongated strip of paper-like material having means mounted on one end thereof detachably engageable by the hook-like protrusions. After attachment, the elongated paper-like strip may be wound with a tress of hair about the tubular member, the paper-like strip completely overlapping the hook-like protrusions to thus prevent entanglement of the tress with the hook-like protrusions. In both embodiments a conventional curler clip is utilized to retain the curler in close proximity to the scalp and prevent inadvertent unwinding of the curler.

BRIEF DESCRIPTION OF THE DRAWINGS

FIG. 1 is a perspective view illustrating one method of application of the hair curler of the invention to a strand or tress of hair in a home environment as distinguished from use by a hairdresser.

FIG. 2 is a perspective view of the hair curler assembly of the invention illustrating the distal end portion of a strand or tress of hair temporarily attached to the anchor means on the periphery of the hair curler and about to be overlapped by the protective strip of paper-like material that precludes the remainder of the tress from coming into contact with the anchor means.

FIG. 12 is a perspective view in exploded form of a third embodiment of the curler assembly, illustrating the separate components prior to assembly.

FIG. 13 is an end view of the third embodiment curler assembly shown in association with the distal end of a tress of hair and illustrating the manner in which the elongated strip of paper-like material is displaced to cover the tress end portions that are anchored to the anchor means.

DESCRIPTION OF THE PREFERRED EMBODIMENTS

Figure 3:
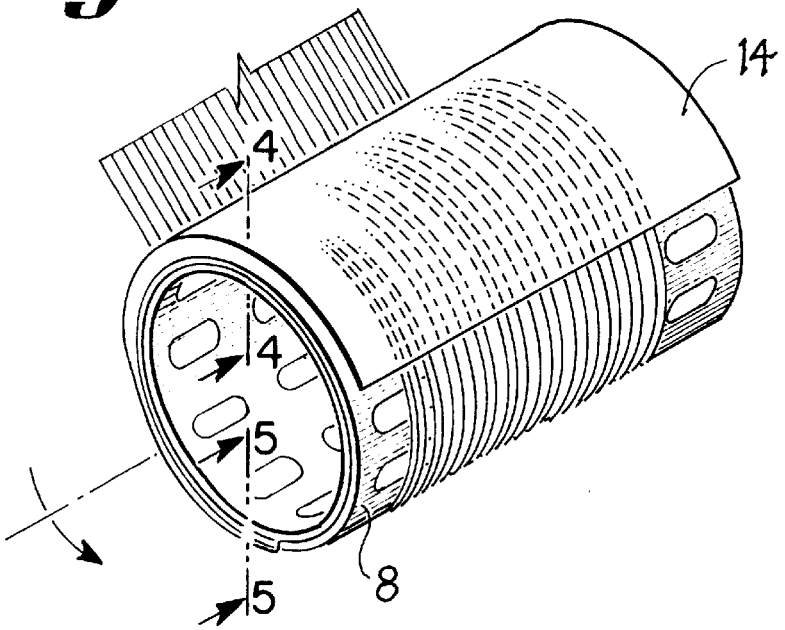
FIG. 3 is a view similar to FIG. 2, but illustrating the anchored distal end portion of the tress of hair and the anchoring means covered or overlapped by the strip of paper-like material.
Figure 4:
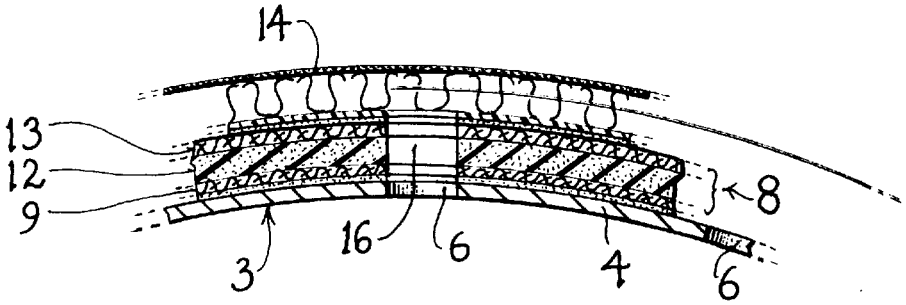
FIG. 4 is a fragmentary cross-sectional view through a peripheral wall portion of the hair curler of one preferred embodiment and illustrating the manner in which a tress of hair is anchored to the anchor means on the periphery of the cylindrical curler and showing how the elongated strip of paper-like material overlaps the anchor means and the anchored distal end portion of the tress to prevent the remaining portion of the tress from engaging the anchor means.

In terms of greater detail, the first embodiment of the hair curler of the invention as illustrated in FIGS. 1–7 is designated generally by the numeral 2 and shows two hair curlers fully applied to the hair and a third in process of being self-applied to the distal end portion of a tress of hair. It should be noted at the outset that FIG. 1 illustrates the hair curler of the invention being applied to the underside of the tress of hair, in which orientation it will be rotated counterclockwise about its longitudinal axis as viewed in FIG. 1 to effect winding of the tress of hair onto the curler. Although not illustrated, it should be understood that the curler may just as easily be oriented on the upper side of the tress of hair, in which case the curler would be rotated clockwise about the longitudinal axis of the curler as viewed in FIG. 1 to effect winding of the tress onto the curler.

The hair curler of the first embodiment of the invention as viewed in FIGS. 1–7 comprises a composite assembly of cooperating elements including a tubular base member, preferably but not necessarily cylindrical, designated generally by the numeral 3 and conveniently formed by a thin-walled cylindrical tube 4 having a nominal length of about 2½" and a diameter ranging from about 1" to about 2". The tube 4 may be formed, for example, from metal or non-metallic materials such as plastic, and the wall of the tube is preferably provided with a multiplicity of circumferentially spaced parallel rows 6 of longitudinally spaced apertures 7 that function to enable the passage of air through the tube wall. The tubular base member thus forms a support structure on which cooperating components are supported, as will hereinafter be explained.

Surrounding the outer periphery of the tube 4 in this first embodiment is a pre-fabricated or pre-formed resiliently cushioned layer designated generally by the numeral 8 and comprising a first or inner fabric layer 9 (FIGS. 4 and 5) adhesively secured to the outer peripheral surface of the tube 4, an intermediate or second layer 12 formed from resiliently compressible foam-like material adhesively secured coaxially to and surrounding the first fabric layer 9, and a third or outer layer 13 of felt-like material adhesively secured coaxially to and surrounding the intermediate or second layer 12. These elements 9, 12 and 13 may be consecutively applied to the outer periphery of the tube 4, but it is preferred that they be preformed or pre-fabricated to form a unitary composite strip of indefinite length that may then be cut into portions of appropriate length which, when applied onto the tube 4 through about 360 degrees, brings their opposite ends into close or near-abutting relationship. Preferably, the unitary composite resiliently compressible strip 8 of indefinite length is coated with adhesive on the side bearing the first or inner fabric layer 9, and the layer of adhesive may initially, prior to assembly, be covered by a removable protective paper strip (not shown) which is removed upon application of the layer 8 to the tubular base member. In like manner, the outer periphery of the tube 4 may be covered with a layer of adhesive that may then also initially, prior to assembly, be covered with a removable protective paper strip (not shown) to prevent inadvertent attachment of unwanted material to the tube 4. It will of course be understood that when the elongated resiliently cushioned layer is cut into portions of finite length to fit about the tube 4, the protective paper strip covering the adhesive on the first layer is also cut and remains on the underside of the cushioned layer portion until removed during assembly for a purpose which will hereinafter be explained.

While the layer 8 has been described as including a first fabric layer 9 and an intermediate or second layer 12, it should be understood that these two layers may be omitted, and only the outer felt-like layer secured adhesively or by other appropriate means to the outer periphery of the tubular base member.

Figure 5:
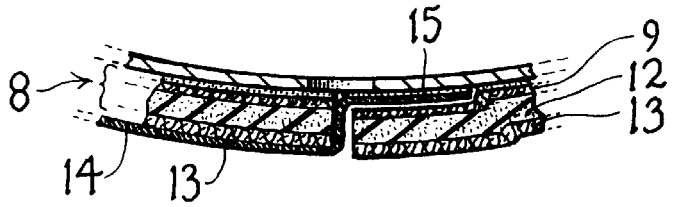
FIG. 5 is a fragmentary cross-sectional view of a portion of the hair curler assembly illustrating the relationship between the near-abutting ends of the resilient and compressible covering in one embodiment and the anchored strip of paper-like material attached to the outer periphery of the tubular cylindrical apertured base member.
Figure 6:
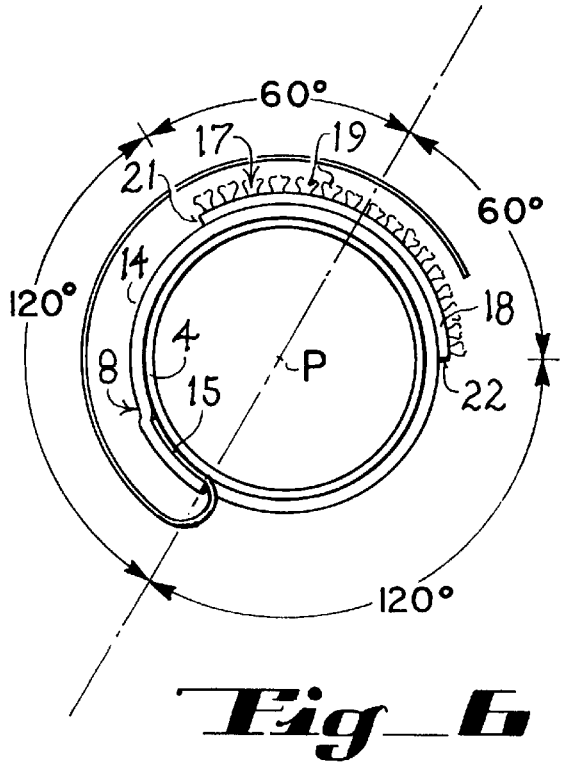
FIG. 6 is an end view of the hair curler embodiment of FIGS. 1–5, illustrating the diametrically opposed relationship of the anchor means for the distal ends of the hair tress, the near-abutting end edges of the resiliently compressible covering, and the attachment of the elongated paper-like strip to the tubular base member and the manner in which the elongated paper-like strip may be wound about the underlying assembly to overlap and cover the anchor means.

Prior to the unitary composite resiliently cushioned layer 8 being wound on and secured to the outer periphery of the tube 4, an elongated strip 14 of paper-like material having a width substantially equal to the length of the tube 4 is permanently attached by one end portion 15 to the adhesively coated outer periphery of the tube 4 at any point on its circumference, the protective strip film normally covering the adhesive on the tube being removed so that the end portion 15 of the elongated paper-like strip may be adhered thereto as shown in FIGS. 5 and 6. The elongated paper-like strip 14 is of sufficient length so that when it is wound about the tube 4 following application of the resiliently cushioned layer 8 thereto, it will extend at least 240 degrees or more about the tube and preferably extend a minimum of 250 degrees about the tube for reasons which will hereinafter be explained. It should of course be understood that when the paper-like strip 14 is wound about the tube 4 and the resiliently cushioned layer 8, the lateral edges of the strip generally coincide with the end edges of the underlying tube 4.

After the end portion 15, say about ¾" wide, of the elongated paper-like strip 14 has been permanently attached to the outer periphery of the tube 4 (FIGS. 5 and 6), the strip is extended radially away from the periphery of the tube, leaving the ¾" end portion 15 of the strip adhesively secured to the tube. Then, one end of the resiliently cushioned composite layer 8 is stripped of its protective strip film and the exposed adhesive on the underside of the resiliently cushioned layer is contiguously superimposed over and adhesively attached to overlap the end portion 15 of the paper-like strip that has previously been adhesively attached to the tube so that the end edge of the resiliently cushioned layer abuts the associated side of the paper-like strip 14.

The resiliently cushioned layer, with the protective strip film removed from the adhesive layer coating the first fabric layer, is then wound about the tube 4 until the opposite or free end of the cushioned layer lies in near-abutting relation to the opposite side of the paper-like strip 14 where it extends radially away from the periphery of the tube as shown in FIG. 5. The cushioned layer is pressed firmly onto the adhesively coated outer periphery of the tube 4, causing the two now contiguous layers of adhesive on the underside of the cushioned layer and on the surface of the tube to permanently secure the cushioned layer 8 to the outer periphery of the tube.

The placement of adhesive on the outer periphery of the tubular base member and covering the adhesive with a removable protective strip film enables the tubular base member to be manufactured by automated means and stored in inventory until assembly is required. In like manner, automated production of the layer 8 with adhesive on one side that is compatible with the adhesive on the tubular base member, which layer of adhesive on the layer 8 is covered by a protective strip film, enables this component of the assembly to be mass-produced and stored until a need for assembly occurs. At that time, the protective film strips may be removed and the components adhesively secured to one another during automated or even hand assembly. Other manufacturing and assembly procedures may of course be utilized, such as applying adhesive coincident with application of the layer 8 to the outer periphery of the tubular base member, or providing some other means for attachment, either temporarily or permanently, of the layer 8 on the outer periphery of the tubular base.

As indicated previously, the apertures 7 formed in the thin-walled tube 4 enable the passage of air therethrough to shorten the drying time of the curled hair. To augment this drying function, the resiliently cushioned layer 8 is also provided with apertures 16 (FIGS. 2 and 4) that coincide with the apertures in the tube 4, thus enabling air to pass through the tube apertures and into and through the hair that is curled thereon so as to shorten the time required to set the hair. In this respect, both the walls of the tube and the layer 8 may be formed from foraminous material to facilitate the passage of air.

To attach the distal ends of a tress of hair to the third layer 13, there is secured, conveniently by adhesive, to the outer felt-like layer 13, in a position diametrically opposed (180 degrees) to the radially extending paper-like strip 14, as seen in FIG. 6, an anchor means designated generally by the numeral 17 and comprising a fabric or synthetic resinous layer or sheet 18 from which project hook-like members or protrusions 19 that extend radially outwardly away from the surface of the layer or sheet 18. The layer or sheet has a length just short of the width of the resiliently cushioned layer 8, and subtends circumferentially approximately 120 degrees about the resiliently cushioned layer, with a median line equidistant from the two long edges 21 and 22 of the anchor means being diametrically coincident with the plane P of the elongated paper-like strip 14 caught between opposite near-abutting end edges of the resiliently cushioned layer 8. See the arrangement in FIG. 6.

It will thus be seen that since the anchor means 17 subtends only about 120 degrees on the opposite side of the tubular member from where the elongated paper-like strip 14 emanates from between the two adjacent end edges of the resiliently cushioned layer 8, the elongated paper-like strip, being minimally of sufficient length to subtend circumferentially at least 240 degrees and preferably 250 degrees of the outer periphery of the resiliently cushioned layer 8, will completely overlap and cover the anchor means 17 after the distal ends of a tress of hair are attached thereto and the elongated paper-like strip 14 is wound about the assembly to cover the distal ends of the tress engaged by the hook-like members projecting from the anchor means. This relationship is illustrated in FIGS. 1 and 3.

From this point, the tubular assembly, as shown in FIG. 1, may be digitally rotated counterclockwise to wind the tress fully onto the curler, as also shown in FIG. 1, whereupon superseding or successive layers of the tress build contiguously one upon the other until the entire tress is wound onto the curler and the curled hair and curler lie snugly against the scalp. Application of a conventional hair curler clip or bobby-pin (not shown) to the curler will retain the curler snugly against the scalp until the curled hair dries or sets.

Figure 7:
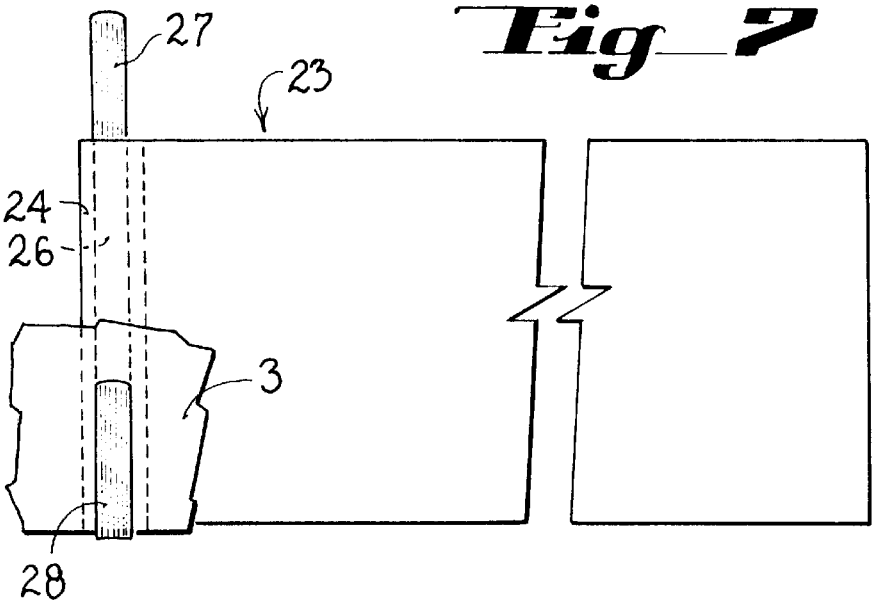
FIG. 7 is a plan view of a first embodiment of an elongated paper separator strip incorporating means for detachable attachment of the strip to the curler assembly embodiment of FIGS. 1–6 for selective interposition of the strip between successive layers of a curled tress.

It will of course be understood that from the position of the curler as illustrated in FIG. 1, if desired, the elongated paper-like strip 14 may be of indeterminate length and cut to the length of the tress, or an additional elongated paper-like strip or paper-like material designated generally by the numeral 23 and as shown in FIG. 7, may be interposed between the curler and the underside of the tress so that when the curler is rotated to wind the tress onto the curler, there will be paper interposed between each superseding or successive layer of curled hair. Preferably, this additional strip 23 of paper is moisture absorbent and permits the passage of air so that when liquid conditioner or other solutions are applied to the curled hair, such conditioners or other solutions may penetrate through the entire thickness of the curled hair.

Referring to FIG. 7, it will be seen that the elongated strip of paper 23 is the same width as the length of the tubular member, and that one end 24 thereof is provided with an attachment means which in the embodiment illustrated in FIG. 7 includes a central body portion 26 to which the associated end 24 of the strip is permanently attached as by adhesive, and reformable or bendable end portions 27 and 28, one of which (28) is shown bent inwardly or re-entrantly, so as to project into the interior of the tubular base member 3 as shown. Thereafter, following application on the tubular member, the opposite bendable end portion may be bent inwardly or re-entrantly to engage the opposite end of the tubular base member. Now when the tubular body is rotated to curl a tress of hair, the elongated paper strip 23 is also rolled up and lies interposed between the successive windings of hair as the tress is curled. Other attachment means, such as a felt pad secured to an end portion of the paper strip and that may be detachably secured to the anchor means 17 may be utilized as will hereinafter be explained.

After the curled hair dries, the curler may be removed by removing the curler clip or bobby-pin and then unrolling the curler so as to unwind the tress from the curler assembly. The distal end of the tress is easily detached from the anchor means without entanglement and without stress to the hair or pain to the customer, and the hair is then dressed in whatever manner suits the customer.

From the above, it will be understood that the curler assembly, following removal from one customer, may conveniently be submerged in water or other solutions to sterilize or disinfect the curler before it is used on another customer. This ensures that bacteria and other maladies are not transferred from one customer to another during the course of a hairdressing appointment. Alternatively, it is contemplated that the cost of the hair curler can be reduced to the point that the curler may be considered to be a disposable and recyclable item and the cost passed on to the customer and a new curler assembly utilized for successive customers, thus eliminating the possibility of contamination being transferred from one customer to another.

Referring to FIGS. 8–11, there is illustrated a second embodiment of the invention, designated generally by the numeral 31. Referring to the drawings, it will be seen that in this embodiment, as with the first embodiment, there is provided a tubular base member 32, again preferably cylindrical but not necessarily so, and having apertures as shown in the side wall as before to permit the passage of air. In this second embodiment there is secured to about one-half (180 degrees) of the outer periphery of the tubular base member 32 a pad 33 having hook-like protrusions 34 projecting from its outer surface, with the opposite or inner surface of the pad being secured as by adhesive to the outer ½ of the peripheral surface of the tubular base member. The pad 33 is generally rectangular, having opposite and parallel long edges 36 and 37 that lie parallel to and generally coincident with a common plane that includes the central longitudinal axis 38 of the tubular base member 32.

Suitably secured to the opposite ½ of the tubular member 32 is a generally rectangular pad designated generally by the numeral 39, having a felt-like surface 41 and opposite long edges 42 and 43 that lie in a common plane that includes the central axis 38, the opposite long edges of the pad 39 abutting the opposite long edges 36 and 37, respectively, of the pad 33 having the hook-like fastener elements 34 protruding therefrom. The end edges of both pads 33 and 39 are preferably coincident with the end edges of the tubular member 32 as shown, i.e., the end edges of the pads 33 and 39 and the end edges of the tubular member lie in a common plane that lies perpendicular to the longitudinal axis 38 of the tubular member. Preferably, the pad 39 is adhesively secured to ½ of the outer peripheral surface of the tubular member in the same manner that the pad 33 is secured to the opposite ½ of the outer peripheral surface of the tubular member as shown in exploded form in FIG. 11.

Figure 8:
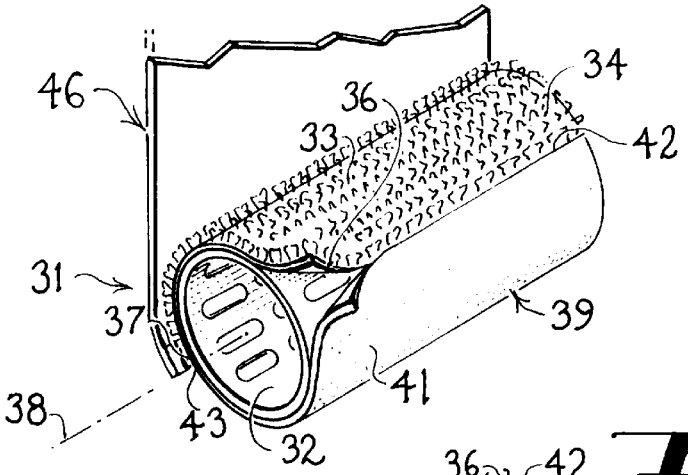
FIG. 8 is a perspective view of a second embodiment of the hair curler assembly illustrating diametrically opposed layers of resiliently compressible felt-like material and hook-like material secured directly to the underlying tubular base member, and the detachable attachment of an elongated paper-like strip to a portion of the hook-like material. A portion of the elongated strip is removed to reduce the size of the view.
Figure 9:
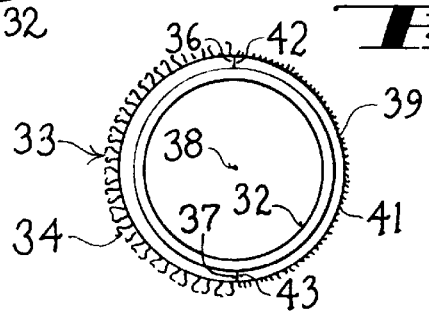
FIG. 9 is an end view of the hair curler assembly of FIG. 8, with the elongated paper-like strip removed for clarity of the view.
Figure 10:
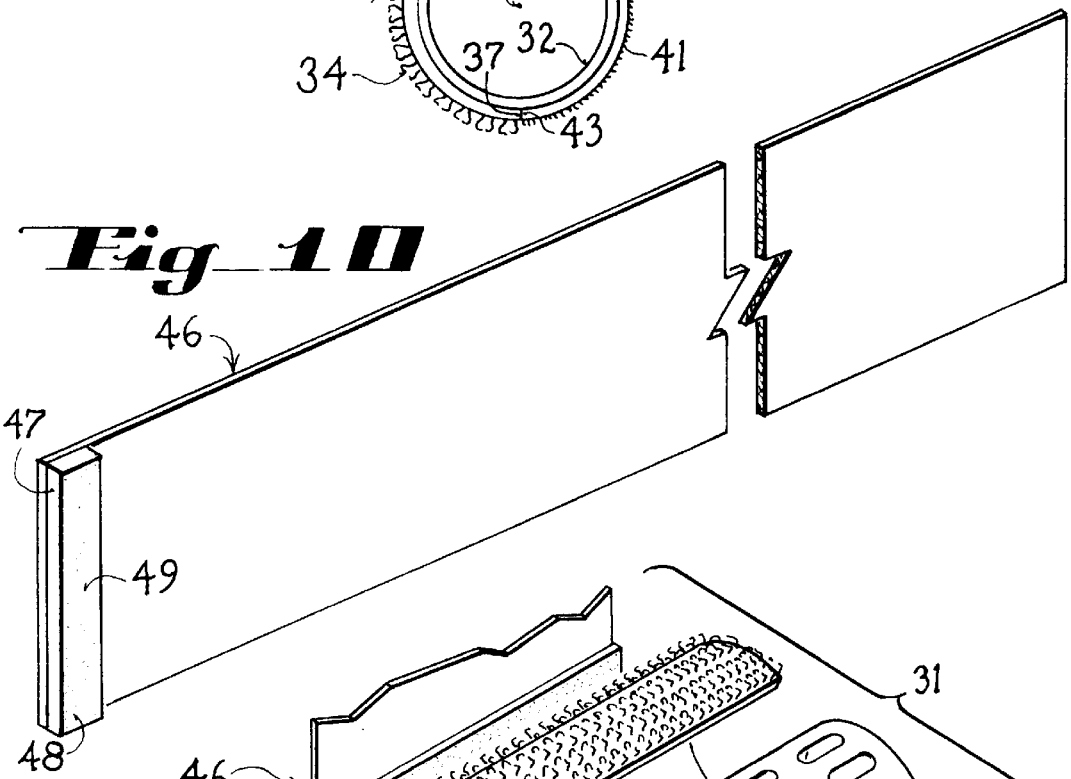
FIG. 10 is a perspective view of the elongated paper-like strip shown apart from other structure. A portion of the strip is broken away to shorten the view.
Figure 11:
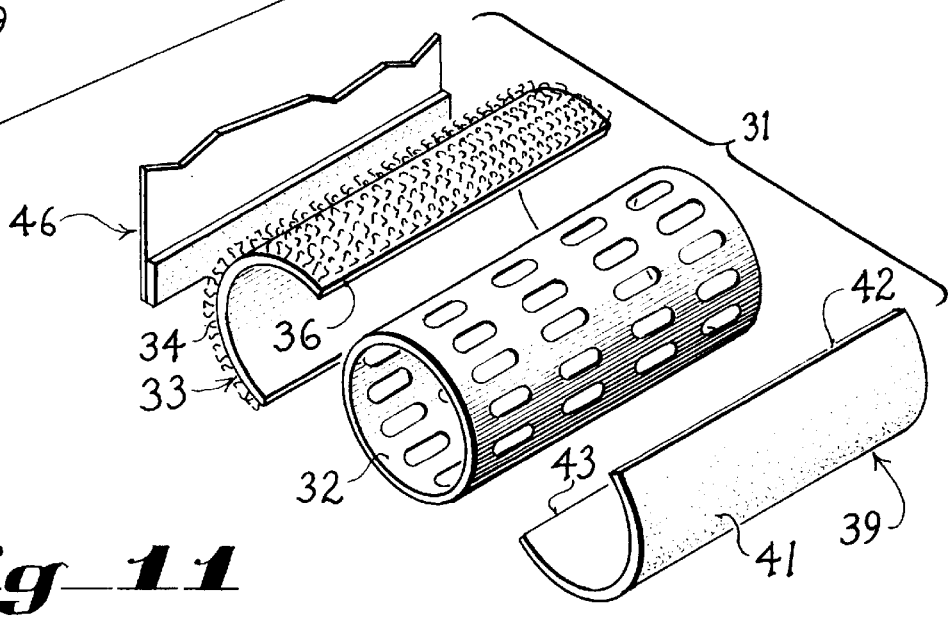
FIG. 11 is a perspective view in exploded form illustrating the relationships of the separate components of the FIG. 8 second embodiment prior to the components being assembled.

Also provided for use with the curler assembly 31 is an elongated paper-like strip designated generally by the numeral 46 and illustrated in FIG. 10 apart from the curler assembly, and illustrated in FIGS. 8 and 11 in association with the curler assembly. The elongated paper-like strip 46 conveniently has a width transverse to its longitudinal dimension that is equal to the length of the tubular member 32. The paper-like strip constitutes a loose assembly of fibrous material arranged in sheet form having openings through the material that enables the passage of air therethrough, yet possesses a cohesiveness that enables the elongated strip to be handled and wrapped with a tress of hair about the curler as shown in FIG. 1. At one end, the paper-like strip 46 is provided with an elongated anchor bar 47 that is adhesively or otherwise attached permanently to a flat end portion of the strip as shown. The anchor bar 47 is conveniently formed from fabric, and is provided on its exposed surface 48 with a layer of felt-like fibers 49 that are adapted to be pressed onto the hook-like protrusions 34 of the anchor pad 33 in the manner illustrated in FIG. 8. The hook-like protrusions embed themselves into the felt-like fibers and detachably engage themselves to the fibers in a manner to resist relative parallel displacement of the bar in relation to the elongated paper strip but enables the bar to be "peeled" from the hook-like protrusions when necessary to remove and replace the anchor bar 47 with another.

As shown in FIG. 8, the anchor bar 47 is pressed onto the pad 33 in an orientation such that the elongated paper strip and a tress of hair may be wound about the curler assembly after the distal ends of the tress of hair have been detachably engaged with the hook-like protrusions 34 formed on the pad 33. Thus, when the curler is rotated counterclockwise as shown by the arrow in FIG. 8, the tress of hair and the elongated paper-like strip will be wound onto the tubular member and be wrapped about the pads 33 and 39 while being precluded by the paper strip from coming into entangling contact with the protruding hook-like members 34. Concommitantly, because of the nature of the paper strip as discussed above, and the apertures in the tubular member and the corresponding apertures in the pads 33 and 39, air may pass through and circulate through the curled tress of hair on the curler so as to enhance drying or setting of the hair.

FIGS. 12 and 13 illustrate a third embodiment of the invention. In this embodiment, a tubular member designated generally by the numeral 51 is provided, conveniently injection molded or otherwise formed from a suitable plastic to provide an elongated lattice-like body 52 symmetrical about a longitudinal axis, and having side walls formed with a multiplicity of apertures 53 defined by longitudinally spaced circumferential members 54 joined integrally by circumferentially spaced and longitudinally extending bars 56 that extend essentially the full length of the tubular member. At each end and at spaced intervals along the length of the tubular body, there is provided integral hoops 57 to provide a measure of strength to the lattice-like tubular body to resist radial compression. The lattice-like walls of the tubular body of course enable the passage of air therethrough for the purpose of drying the hair.

Whereas in the second embodiment of the invention described above and illustrated in FIGS. 8–11 the pad 33 bearing the hook-like protrusions encompassed only ½ of the outer peripheral circumference of the tubular member 32, in this third embodiment of the invention, a larger generally rectangular pad designated generally by the numeral 58 is provided that is dimensioned to circumferentially surround the entire 360 degree outer peripheral circumference of the tubular member and is adapted to be permanently secured thereto by adhesive applied between the back side 59 of the pad and the lattice-like surface of the tubular member 51. The opposite or exposed surface of the pad is provided with radially protruding hook-like members 61 over its entire surface. As seen in FIG. 13, when the pad is applied about the tubular member 51, the opposed end edges 62 and 63 abut one another to form a closed joint that extends longitudinally of the tubular member parallel to the longitudinal axis thereof. Opposite side edges 64 and 66 are generally coincident with the associated corresponding end edges of the tubular member 51.

Following application of the pad 58 about the peripheral circumference of the tubular lattice-like member 51, a felt-like pad designated generally by the numeral 67, and dimensioned to encompass only about ½ of the circumference of the pad 58, is applied over and detachably secured to the hook-like members 61 surfaces, is applied so that its width spans the joint formed by the abutting end edges 62 and 63 of the underlying pad having hook-like members protruding into the felt-like pad 67, thus functioning to firmly retain the end edges 62 and 63 abutted as shown even in the absence of adhesive between the undersurface 59 of the pad 58 and the outer peripheral surfaces of the tubular member 51. This arrangement is illustrated in FIG. 13, where it is also shown that the opposite long edges 69 and 71 of the felt pad 67 are generally diametrically opposed on opposite sides of the central axis of the tubular member.

As with the second embodiment of the invention illustrated in FIGS. 8–11, in this third embodiment there is also provided an elongated paper-like strip designated generally by the numeral 72 having an elongated body 73 of determinate length and a width that essentially matches the length of the tubular member 51. On one end portion of the elongated paper-like strip there is mounted transverse to the long dimension of the strip a felt-like fabric bar 74 having an exposed surface 76 that is "felted" to provide a bed of fibers that may be detachably attached to the hook-like protrusions on the pad 58, as illustrated in FIG. 13. Thus, when the distal ends 77 of the tress of hair 78 are anchored to the portion of the pad 58 that has hook-like members exposed, as previously discussed, and the tubular curler body is rotated counterclockwise, the tress of hair is wound onto the curler and the elongated strip of paper-like material is also wound onto the tubular curler body, covering the hook-like protrusions so that as rotation progresses the remainder of the tress is wound onto the elongated paper-like strip and does not come into contact with the hook-like members and is therefore not entangled with the hook-like members.

It will thus be seen that one of the advantages of this third embodiment is that the components of the curler assembly may all be pre-formed or pre-manufactured as separate components and then packaged as a kit in individual packages, ready for assembly as needed with a customer. While it has been stated that the pad 58 may be adhesively secured to the underlying tubular lattic-like member 51, it will be apparent to those skilled in the art that the adhesive may be omitted and the pad 58 held securely onto the outer peripheral surface of the tubular member by application of the felt pad 67 thereover, securely holding the underlying pad 58 onto the tubular member by virtue of the engagement of the hook-like protrusions 61 of the pad 58 in the overlying felt pad 67, thus eliminating the need for adhesive.

Having thus described the invention, what is believed to be new and novel and sought to be protected under the patent laws of the United States is as follows.

I claim:

1. A hair curler about which a tress of hair may be wound and set to curl the tress, comprising in cooperative combination:

a) a tubular base member symmetrical about a longitudinal axis and having inner and outer peripheries;

b) means mounted on said tubular base member having a non-slip felt-like surface thereon parallel to said outer periphery for cushioning said tress of hair when wound thereon;

c) anchor means supported on said tubular base member and to which anchor means the distal ends of a tress of hair may be detachably anchored; and d) elongated paper-like strip means mounted by one end thereof on said tubular base member, said elongated paper-like strip means being flexible and digitally manipulable to wrap about said tubular base member to overlap and cover said anchor means and the distal ends of said tress detachably anchored thereon.

2. The hair curler combination according to claim 1, wherein said tubular base member is cylindrical and fabricated from a material selected from the group consisting of metal, non-ferrous metal or plastic.

3. The hair curler combination according to claim 1, wherein said tubular base member is provided with a plurality of spaced apertures that penetrate through said inner and outer peripheries.

4. The hair curler combination according to claim 1, wherein said means on the outer periphery of said tubular base member providing a non-slip felt-like surface comprises a flexible multi-layer pad of laminated material secured to the outer periphery of said tubular base member.

5. The hair curler combination according to claim 1, wherein said anchor means comprises a flexible pad having hook-like protrusions extending radially therefrom.

6. The hair curler combination according to claim 1, wherein said means mounted on said tubular base member having a non-slip felt-like surface comprises a multi-layer flexible pad.

7. The hair curler combination according to claim 1, wherein said tubular base member is fabricated from plastic and provided with lattice-like walls.

8. The hair curler combination according to claim 1, wherein said tubular base member is open at opposite ends.

9. The hair curler combination according to claim 1, wherein said means having a non-slip felt-like surface is mounted on the outer periphery of said tubular member.

10. The hair curler combination according to claim 1, wherein said means having a non-slip felt-like surface is mounted on the outer periphery of said tubular member and includes a multi-layer laminated body forming a pad one layer of which is formed from resiliently compressible material.

11. The hair curler combination according to claim 1, wherein said means having a non-slip felt-like surface is mounted on the outer periphery of said tubular member and concentrically surrounds said tubular member through 360 degrees.

12. The hair curler combination according to claim 1, wherein said anchor means comprises a flexible pad having hook-like members projecting radially from said pad, and said anchor means is mounted medianly on said non-slip felt-like surface and subtends an arc of about 120 degrees concentric to said non-slip felt-like surface.

13. The hair curler combination according to claim 1, wherein said anchor means is concentrically superimposed medianly on said non-slip felt-like surface and adhesively secured thereto 180 degrees opposed to where said elongated paper-like strip is mounted by one end on said tubular member, whereby winding of said paper-like strip in either direction about said tubular member effects overlapping of said paper-like strip over said anchor means and the distal ends of a tress of hair anchored thereto.

14. The hair curler combination according to claim 1, wherein means are provided on one end of said elongated paper-like strip digitally manipulable to detachably mount said elongated paper-like strip on said tubular member.

15. The hair curler combination according to claim 1, wherein said means mounted on said tubular member and having a non-slip felt-like surface circumferentially encompasses about 180 degrees of the outer periphery of said tubular member.

16. The hair curler combination according to claim 1, wherein said anchor means is mounted on said tubular member and circumferentially encompasses about 180 degrees of the outer periphery of said tubular member.

17. The hair curler combination according to claim 3, wherein said plurality of spaced apertures are arranged in circumferentially spaced rows of longitudinally spaced apertures, said anchor means comprises a flexible pad wrapped 360 degrees about and secured to the outer periphery of said tubular base member so that opposite edges of the pad abut, said pad having flexible hook-like projections extending radially therefrom, and said means having a felt-like surface is wrapped 180 degrees about said anchor means and detachably secured to said flexible hook-like projections.

18. The hair curler combination according to claim 16, wherein said elongated paper-like strip is detachably attached by one end thereof to said anchor means whereby said paper-like strip may be wound about said tubular member with a tress of hair so that except for the distal ends of the tress anchored to said anchor means, the paper-like strip is interposed between the tress and said anchor means.

19. A hair curler about which a tress of hair may be wound and set to curl the tress, comprising in cooperative combination:

a) a tubular base member symmetrical about a longitudinal axis and having inner and outer peripheries;

b) means mounted on a portion of said outer periphery of said tubular body and providing a non-slip felt-like surface;

c) anchor means mounted on the remaining portion of said outer peripheral surface of said tubular member for anchoring the distal ends of a tress of hair; and d) elongated paper-like strip means mounted by one end thereof on said anchor means, said elongated paper-like strip means being flexible and digitally manipulable to wrap about said tubular base member to overlap and cover said anchor means and at least the distal ends of said tress detachably anchored thereon.

20. The hair curler combination according to claim 19, wherein said tubular base member is cylindrical, said portion of said outer periphery on which said means providing a non-slip felt-like surface is mounted subtends and angle of 180 degrees, and said remaining portion of said outer periphery on which said anchor means is mounted subtends an angle of 180 degrees.

21. The hair curler combination according to claim 19, wherein an anchor bar is attached to said one end of said paper-like strip, said anchor bar extending transversely across said strip and having a felt-like surface thereon selectively detachably engageable with said anchor means mounted on said tubular base member.

22. A hair curler about which a tress of hair may be wound and set to curl the tress, comprising in cooperative combination:

a) a tubular base member symmetrical about a longitudinal axis and having inner and outer peripheries;

b) anchor means mounted on the outer periphery of said tubular base member and extending for 360 degrees thereabout, said anchor means having a multiplicity of flexible hook-like projections;

c) means providing a non-slip felt-like surface mounted on the anchor means, said felt-like surface detachably engaging said flexible hook-like projections; and d) an elongated paper-like strip mounted by one end thereof on said anchor means, said elongated paper-like strip being flexible and digitally manipulable to wrap about said anchor means and said means providing a non-slip felt-like surface whereby when said tress is wound about said tubular base member with said elongated paper-like strip, said strip lies interposed between successive layers of said tress.

23. The hair curler combination according to claim 22, wherein said anchor means comprises a pad from one surface of which project said flexible hook-like projections, said pad having opposite end edges which abut when said pad is mounted by wrapping it about said tubular base member, and said means providing a non-slip felt-like surface comprises a pad having opposed long edges, said pad being superimposed over said anchor means pad so that said felt-like surface is detachably engaged by the flexible hook-like projections on the underlying anchor means pad, said felt-like surface of said pad spanning the abutted edges of said anchor means pad.

24. The hair curler combination according to claim 23, wherein said anchor means pad is equal in width and about twice the length of said felt-like pad, the length of said anchor means pad being equal to the circumference of said tubular base member and the width thereof equal to the length of said tubular base member.

* * * * *